US007357107B2

(12) United States Patent
Nagano et al.

(10) Patent No.: US 7,357,107 B2
(45) Date of Patent: Apr. 15, 2008

(54) VALVE SYSTEM FOR INTERNAL COMBUSTION ENGINE

(75) Inventors: Shuji Nagano, Okazaki (JP); Toshihiko Oka, Anjyo (JP); Masanori Tokuhisa, Rittou (JP)

(73) Assignees: Mitsubishi Jidosha Kogyo Kabushiki Kaisha, Tokyo (JP); Mitsubishi Jidosha Engineering Kabushiki Kaisha, Kawasaki-shi (JP)

( * ) Notice: Subject to any disclaimer, the term of this patent is extended or adjusted under 35 U.S.C. 154(b) by 324 days.

(21) Appl. No.: 10/735,893

(22) Filed: Dec. 16, 2003

(65) Prior Publication Data

US 2004/0154569 A1 Aug. 12, 2004

(30) Foreign Application Priority Data

Dec. 17, 2002 (JP) ..... 2002-364601

(51) Int. Cl.
*F01L 1/34* (2006.01)

(52) U.S. Cl. ..... 123/90.16; 123/90.15; 123/90.39

(58) Field of Classification Search ..... 123/90.16, 123/90.15, 90.39
See application file for complete search history.

(56) References Cited

U.S. PATENT DOCUMENTS 4,713,704 A * 12/1987 Voll et al. ..... 360/97.02
5,682,847 A * 11/1997 Hara ..... 123/90.16

FOREIGN PATENT DOCUMENTS

| | | | |
|---|---|---|---|
| DE | 19614825 | A1 | 4/1997 |
| DE | 19619775 | A1 | 4/1997 |
| DE | 19642059 | A1 | 4/1997 |
| EP | 0601250 | A1 | 6/1994 |
| JP | 63-170513 | A | 7/1988 |
| JP | 2001-41017 | A | 2/2001 |
| JP | 2001-182506 | A | 7/2001 |
| JP | 2001-182508 | A | 7/2001 |
| JP | 2001-336407 | A | 12/2001 |
| WO | WO-90/15916 | A1 | 12/1990 |

OTHER PUBLICATIONS

Böge, Alfred; Mechanik und Festigkeitslehre; 17, überabeitete Auflage; Braunschweig (u.a.); Friedrich Vieweg & Sohn, 1979; Seiten 259, 281, 302, und 303.

* cited by examiner

*Primary Examiner*—Zelalem Eshete
(74) *Attorney, Agent, or Firm*—Birch, Stewart, Kolasch & Birch, LLP

(57) ABSTRACT

There is provided a valve system for an internal combustion engine, in which a rocker shaft required to have a higher stiffness has a larger diameter. A rocker shaft on an intake side is formed to have a larger diameter than that of a rocker shaft on an exhaust side, and therefore, it is possible to ensure such stiffness as to compensate for an excess in weight and to improve valve operating characteristics of a valve system.

12 Claims, 10 Drawing Sheets

VALVE SYSTEM FOR INTERNAL COMBUSTION ENGINE

CROSS-REFERENCE TO RELATED APPLICATION

This nonprovisional application claims priority under 35 U.S.C. § 119(a) on Patent Application No. P2002-364601 filed in Japan on Dec. 17, 2002, the entire contents of which are hereby incorporated by reference.

BACKGROUND OF THE INVENTION

1. Field of the Invention

The present invention relates to a valve system for an internal combustion engine, which is capable of driving intake valves and exhaust valves of the internal combustion engine to open and close.

2. Description of Related art

Conventionally, as disclosed in e.g., Japanese Laid-Open Patent Publication (Kokai) No. 2001-182508 and Japanese Laid-Open Patent Publication (Kokai) No. 2001-182506, a variety of valve systems, which actuate intake valves and exhaust valves of a reciprocating internal combustion engine, have been proposed.

In the conventional valve systems, various measures have been taken to reduce weight and realize proper arrangement so as to ensure proper rocking of rocker arms and suppress e.g., uneven wear of rocker shafts. The rocker shafts are required to have enough stiffness to support the rocker arms and the like, and are disposed on respective ones of an intake side and an exhaust side. To share parts on the intake side and the exhaust side, the rocker shafts on the intake side and the exhaust side are ordinarily comprised of identical parts.

In recent years, a valve system, capable of optimizing operating characteristics (e.g., opening/closing timing, an opening time period, and so forth) of engine valves according to engine load and engine revolution speed, has been developed and put into practical use. To optimize the operating characteristics in this valve system, a mechanism has been developed which is capable of opening and closing the engine valves by selectively using a low-speed cam with a cam profile suitable for low-speed engine revolution or a high-speed cam with a cam profile suitable for high-speed engine revolution according to the revolutionary state of the engine as disclosed in Japanese Laid-Open Patent Publication (Kokai) No. 63-170513 and Japanese Laid-Open Patent Publication (Kokai) No. 2001-41017, for example.

Among the conventional valve systems, there are types which are capable of selectively opening or closing the engine valves, and accordingly, the rocker shaft has been required to additionally support a cam switching mechanism. For example, in the cam switching mechanism, a switching means is hydraulically operated so that pressurized oil, as a drive source, can be supplied and released via the rocker shaft. For this reason, the rocker shaft for the engine valves, which require switching between cams, has been required to have a higher stiffness. However, since the rocker shafts are ordinarily formed of identical parts so that they can be shared, the rocker shafts are formed of parts with diameters suitable for the rocker shaft required to have a higher stiffness.

SUMMARY OF THE INVENTION

It is therefore an object of the present invention to provide a valve system for an internal combustion engine, in which a rocker shaft required to have a higher stiffness has a larger diameter.

To attain the above object, there is provided a valve system for an internal combustion engine, that comprises: an intake-side rocker shaft; an exhaust-side rocker shaft; intake-side rocker arms that have ends thereof connected to intake valves, are supported on the intake-side rocker shaft such that the intake-side rocker arms are capable of rocking, and are driven by an intake cam; and exhaust-side rocker arms that have ends thereof connected to exhaust valves, are supported on the exhaust-side rocker shaft such that the exhaust-side rocker arms are capable of rocking, and are driven by an exhaust cam, wherein one of the rocker shafts required to have a higher stiffness has a larger diameter. Therefore, the stiffness can be improved while minimizing an increase in the total weight of the valve system by increasing the diameter of only the rocker shaft required to have a high stiffness.

It is preferred that the intake-side rocker arms comprise a first rocker arm that has an end thereof connected to the intake valve, is supported on the intake-side rocker shaft such that the first rocker arm is capable of rocking, and is driven by a first low-lift cam; a second rocker arm that has an end thereof connectable to the first rocker arm, is supported on the intake-side rocker shaft such that the second rocker arm is capable of rocking, and is driven by a high-lift cam causing a larger valve lift than the first low-lift cam; and a connection switching mechanism that selectively connects or disconnects the second rocker arm to or from the first rocker arm, and wherein the intake-side rocker shaft has a larger diameter than a diameter of the exhaust-side rocker shaft. Therefore, the stiffness can be improved while minimizing an increase in the total weight of the valve system by increasing the diameter of only the intake-side rocker shaft which is required to have such a high stiffness as to support the connection switching mechanism as a cam switching mechanisms.

Further, it is preferred that the intake valves comprise a first intake valve and a second intake valve; and the intake-side rocker arms comprise a first rocker arm that has an end thereof connected to the first intake valve, is supported on the intake-side rocker shaft such that the first rocker arm is capable of rocking, and is driven by a first low-lift cam; a third rocker arm that has an end thereof connected to the second intake valve, is supported on the intake-side rocker shaft such that the third rocker arm is capable of rocking, and is driven by a second low-lift cam capable of causing a smaller valve lift than the first low-lift cam; a second rocker arm that has an end thereof connectable to the first rocker arm, is supported on the intake-side rocker shaft such that the second rocker arm is capable of rocking, and is driven by a high-lift cam capable of causing a larger valve lift than the first low-lift cam; and a connection switching mechanism that selectively connects or disconnects the second rocker arm to or from the first rocker arm and the third rocker arm, and wherein the intake-side rocker shaft has a larger diameter than a diameter of the exhaust-side rocker shaft. Therefore, the stiffness can be improved while minimizing an increase in the total weight of the valve system by increasing the diameter of only the intake-side rocker shaft required to have such a high stiffness as to support the complicated and heavy switching mechanism as a cam switching mechanism on the side where the second intake valve is provided.

Further, it is preferred that the intake-side rocker arms comprise center-pivot type rocker arms with middle parts thereof pivoted by the intake-side rocker shaft. Therefore, even in the valve system in which the stiffness of the rocker shaft highly contributes to the stiffness of valve system, the stiffness can be improved while minimizing an increase in the total weight of the valve system by increasing the diameter of only the rocker shaft required to have a high stiffness.

Further, it is preferred that the intake-side rocker arms and the exhaust-side rocker arms are driven by a single cam shaft disposed between the intake-side rocker shaft and the exhaust-side rocker shaft. Therefore, even in the valve system having the rocker shafts which should be necessarily increased so as to prevent curving or twisting, the stiffness can be improved while minimizing an increase in the total weight of the valve system by increasing the diameter of only the rocker shaft required to have a high stiffness.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

An embodiment of a valve system for an internal combustion engine according to the present invention will now be described with reference to the accompanying drawings.

Figure 1:
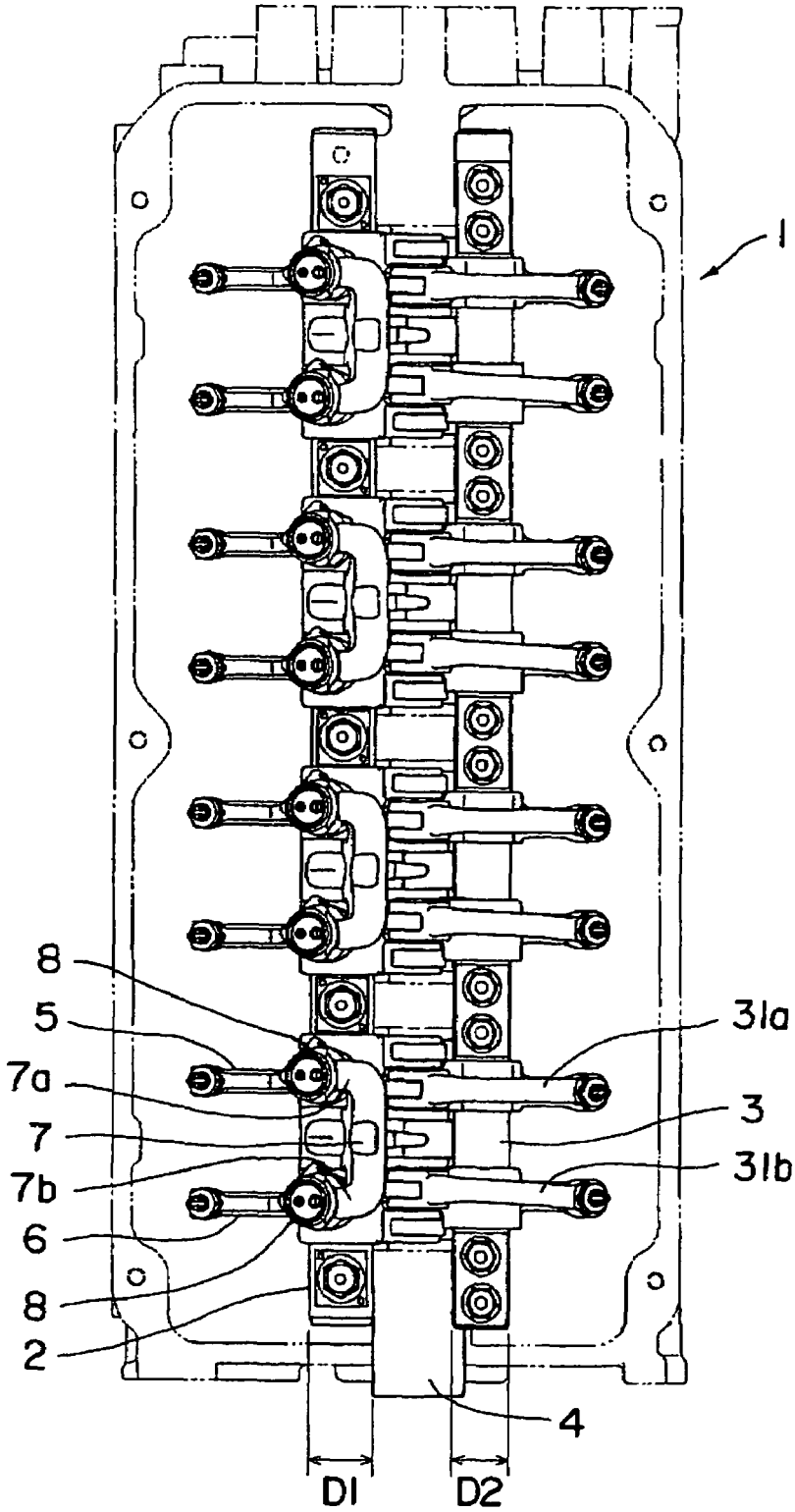
FIG. 1 is a plan view showing a head of an internal combustion engine equipped with a valve system according to an embodiment of the present invention.

As shown in FIG. 1, a rocker shaft 2 on an intake side and a rocker shaft 3 on an exhaust side are arranged parallel to each other and fixed to a cylinder head 1. A cam shaft 4 is rotatably supported on part of the cylinder head 1 between the rocker shaft 2 and the rocker shaft 3. In the illustrated example, an internal combustion engine is comprised of four cylinders arranged in series, for each of which two intake valves and two exhaust valves are provided.

As shown in FIGS. 1 to 5, for each cylinder, a first rocker arm 5 and a third rocker arm 6 are supported on the rocker shaft 2 such that the arms 5 and 6 may rock. A T-shaped second rocker arm 7 is supported on part of the rocker shaft 2 between the first rocker arm 5 and the third rocker arm 6 such that the arm 7 may rock. Cylinder parts 8 serving as a connection switching mechanism are formed on respective ones of the first rocker arm 5 and the third rocker arm 6, and T-shaped ends 7*a*, 7*b* of the second rocker arm 7 are connectable to the cylinder parts 8.

The first rocker arm 5 has an end thereof connected to a first intake valve 9 and a base end thereof adapted to be driven by a first low-lift cam 10. The third rocker arm 6 has an end thereof connected to a second intake valve 11 and a base end thereof adapted to be driven by a second low-lift cam 12 which causes a lower valve lift than the first low-lift cam 10. Namely, the first intake valve 9 and the second intake valve 11 are opened and closed at predetermined timings and with different valve lifts. It should be noted that the second low-lift cam 12 may be designed to have such a shape as to substantially suspend the intake valve 11.

As shown in FIGS. 3, 4, 7, and 8, the cylinder parts 8 are formed on the respective ones of the first rocker arm 5 and the third rocker arm 6. The cylinder parts 8 are formed with respective openings 13*a*, 13*b* opposed to the T-shaped ends 7*a*, 7*b* of the second rocker arm 7.

Pistons 14*a*, 14*b* are provided in the respective cylinder parts 8 so that the pistons 14*a*, 14*b* can slide in contact with the cylinder parts 8. The pistons 14*a*, 14*b* are provided with cylindrical parts 15*a*, 15*b* which slide in contact with inner walls of the cylinder parts 8, and are formed with notches 16*a*, 16*b* notched in the vicinity of the openings 13*a*, 13*b* and continuously from the upper parts of the cylindrical parts 15*a*, 15*b*.

Figure 4:
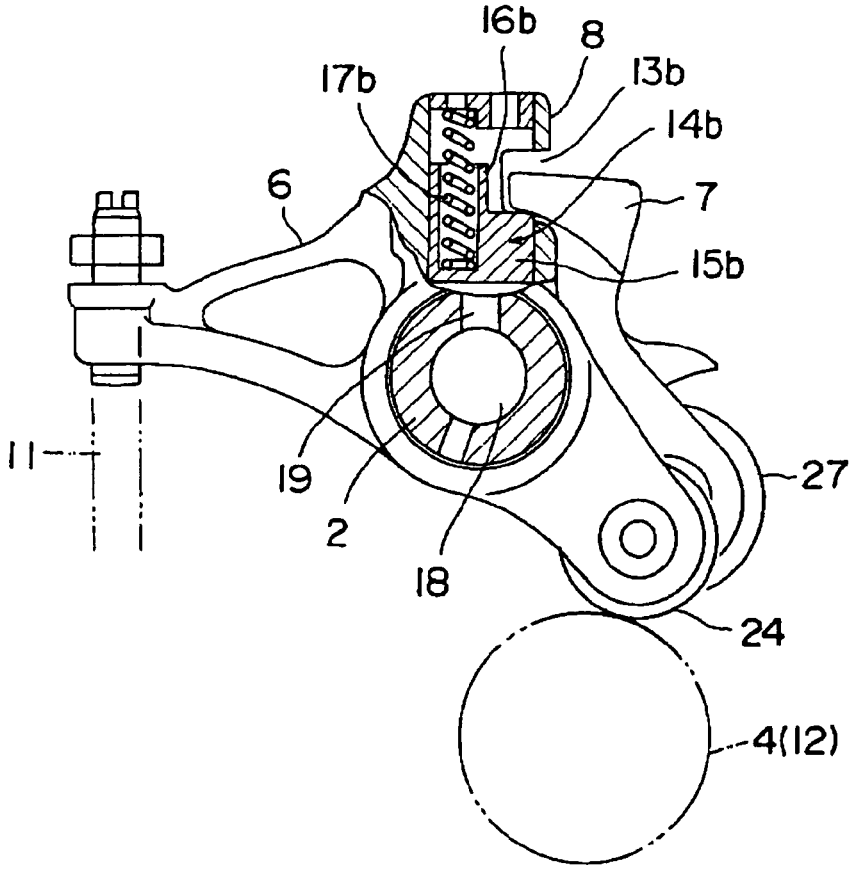
FIG. 4 is a view taken in the direction of an arrow along line IV-IV of FIG. 2.

Further, the pistons 14*a*, 14*b* are forced downward by return springs 17*a*, 17*b*, and normally the notches 16*a*, 16*b* face the openings 13*a*, 13*b* as shown in FIG. 4. An oil channel 18 is formed on an axis of the rocker shaft 2, and is supplied with pressurized oil in predetermined timing by a pressurized oil-supplying mechanism, described later.

Figure 3:
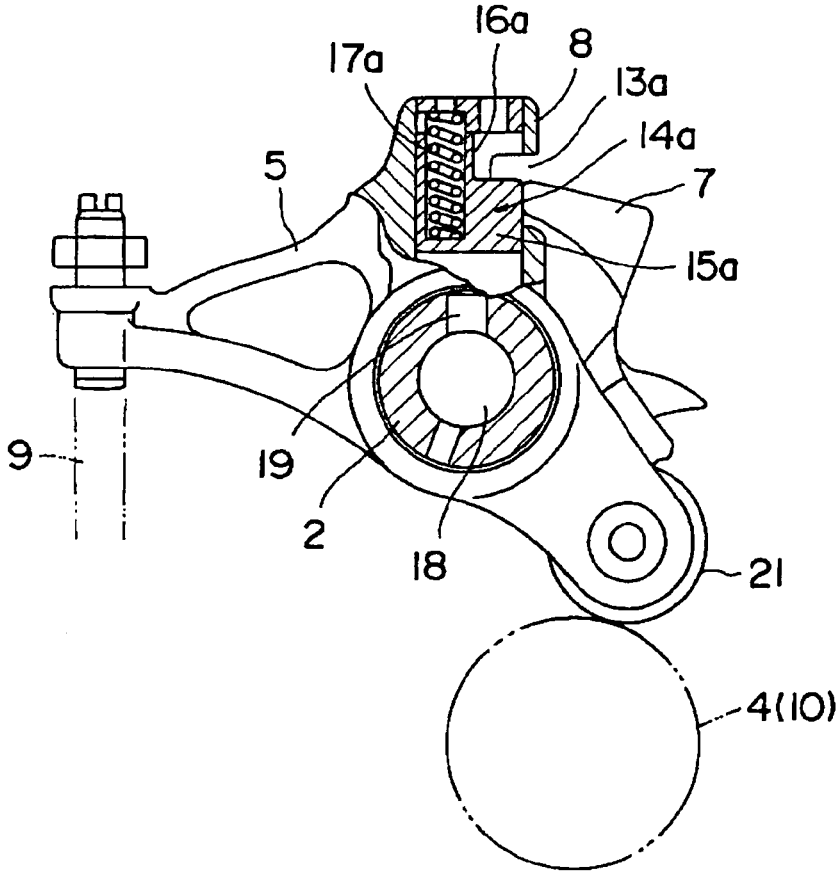
FIG. 3 is a view taken in the direction of an arrow along line III-III of FIG. 2.

The pressurized oil is supplied to the oil channel 18 through a channel 19, causing the pistons 14*a*, 14*b* to move upward against forces of the return springs 17*a*, 17*b*. The upward movement of the pistons 14*a*, 14*b* resulting from the supply of the pressurized oil causes the cylindrical parts 15*a*, 15*b* to face the openings 13*a*, 13*b* as shown in FIG. 3.

As shown in FIGS. 1 to 5, the second rocker arm 7 has the T-shaped ends 7*a*, 7*b* thereof connected to insides of the openings 13*a*, 13*b*, and a base end thereof adapted to be driven by a high-lift cam 20. The high-lift cam 20 causes a higher valve lift as compared to the first low-lift cam 10 and the second low-lift cam 12, and has a cam profile encompassing the cam profile of the first low-lift cam 10 and the second low-lift cam 12.

In the state in which the pistons 14*a*, 14*b* are forced downward by the return springs 17*a*, 17*b* and the notches 16*a*, 16*b* face the openings 13*a*, 13*b* (i.e., no pressurized oil is supplied), when the second rocker arm 7 is driven by the high-lift cam 20, the T-shaped ends 7*a*, 7*b* of the second rocker arm 7 are caused to face the notches 16*a*, 16*b* within the openings 13*a*, 13*b*.

Therefore, in the case where the high-lift cam 20 drives the second rocker arm 7 to rock, the ends 7*a*, 7*b* of the second rocker arm 7 enter the notches 16*a*, 16*b* (i.e., a disconnected state), and the rocking force of the second rocker arm 7 is transmitted to neither the first rocker arm 5 nor the third rocker arm 6.

Therefore, by releasing the pressurized oil from the cylinder parts 8, the rocking forces of the first rocker arm 5 and the third rocker arm 6 causes the first intake valve 9 and the second intake valve 11 to open and close at a predetermined timing and with different valve lifts, i.e., valve lifts suitable for respective shapes of the first low-lift cam 10 and the second low-lift cam 12.

When the pressurized oil is supplied to the cylinder parts 8 to cause the pistons 14*a*, 14*b* to move upward against forces of the return springs 17*a*, 17*b* and to cause the cylindrical parts 15*a*, 15*b* to face the openings 13*a*, 13*b*, the T-shaped ends 7*a*, 7*b* of the second rocker arm 7 are opposed to the cylindrical parts 15*a*, 15*b* within the openings 13*a*, 13*b*.

Therefore, in the case where the high-lift cam 20 drives the second rocker arm 7 to rock, the T-shaped ends 7*a*, 7*b* of the second rocker arm 7 abut the cylindrical parts 15*a*, 15*b* (i.e., a connected state), and the rocking force of the second rocker arm 7 is transmitted to the first rocker arm 5 and the third rocker arm 6 via the cylinder parts 8.

Therefore, the supply of pressurized oil to the cylinder parts 8 opens and closes the first intake valves 9 and the second intake valve 11 with a large valve lift corresponding to the cam profile of the high-lift cam 20 due to the rocking of the first rocker arm 5 and the third rocker arm 6 caused by the rocking of the second rocker arm 7.

Whether pressurized oil is to be supplied to or released from the cylinder parts 8, i.e., whether the second rocker arm 7 is to be connected to or disconnected from the first rocker arm 5 and the third rocker arm 6 is set in advance according to vehicle driving conditions (the revolutionary speed of the internal combustion engine).

For example, when the internal combustion engine is revolving at a low speed, oil pressure is released from the cylinder parts 8 to rock the first rocker arm 5 and the third rocker arm 6, thus opening and closing the first intake valve 9 and the second intake valve 11 in respective predetermined timing and with different valve lifts. This promotes swirling to intensify combustion.

On the other hand, when the internal combustion engine is revolving at a high speed, oil pressure is supplied to the cylinder parts 8 to rock the second rocker arm 7, thus rocking the first rocker arm 5 and the third rocker arm 6, thus opening and closing the first intake valve 9 and the second intake valve 11 at the same time and with large lift valves. This ensures a large amount of intake air to increase engine power.

Figure 7:
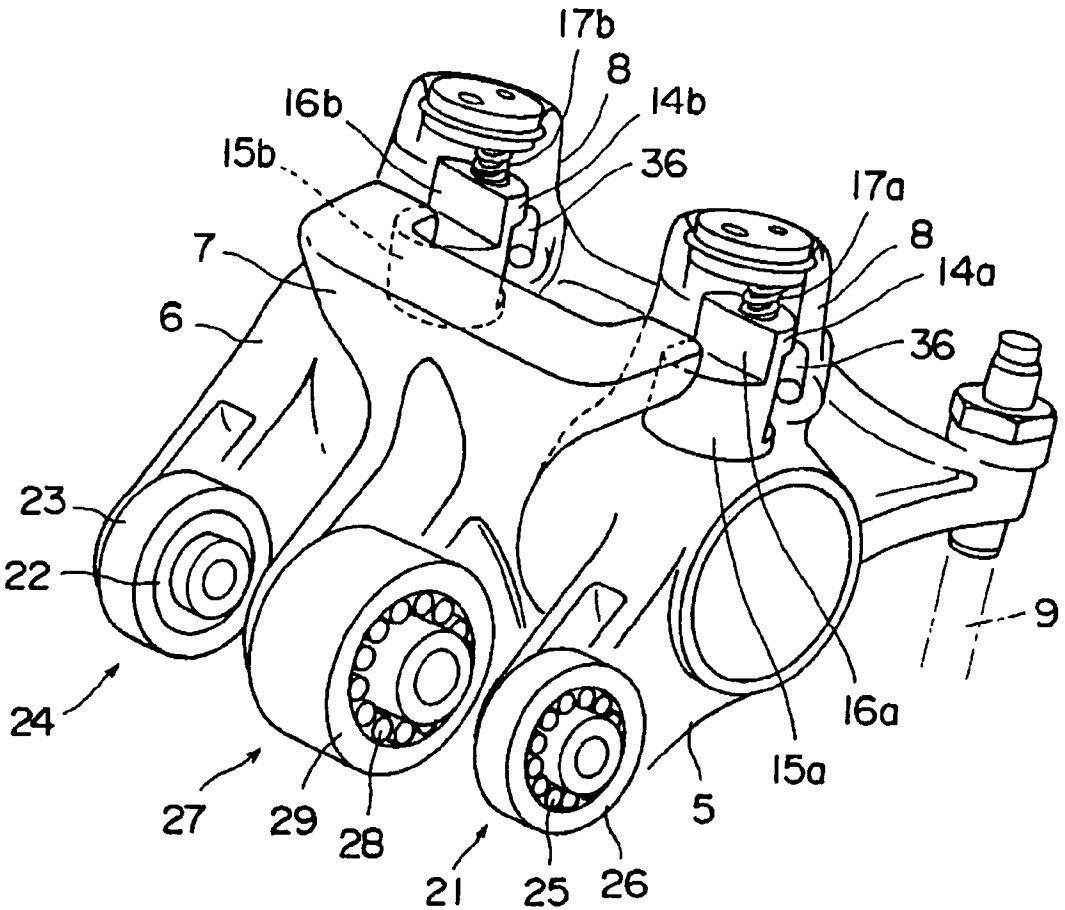
FIG. 7 is a perspective view showing a rocker arm as viewed from a cam shaft.

As shown in FIGS. 3 and 7, a first roller follower 21 is provided in part of the base end of the first rocker arm 5, which is abutted on the first low-lift cam 10. Thus, the base end of the first rocker arm 5 is abutted with the minimum resistance on the rotating first low-lift cam 10 via the first roller follower 21. As shown in FIG. 7, the first roller follower 21 (needle bearing) is comprised of an external roller 26 which is capable of rotating via a large number of needle rollers 25 and is in rolling contact with the first low-lift cam 10.

As shown in FIGS. 4 and 7, a third roller follower 24 is provided in part of the base end of the third rocker arm 6, which is abutted on the second low-lift cam 12. Thus, the base end of the third rocker arm 6 is abutted with no resistance on the rotating second low-lift cam 12 via the third roller follower 24. As shown in FIG. 7, the third roller follower 24 is comprised of an internal roller 22 and an external roller 23 (double-ring type sliding rollers), which are rotatably engaged with each other and concentric with each other. The external roller 23 is in rolling contact with the second low-lift cam 12. The surface of the internal roller 22 is e.g., surface-treated so that it can be smooth.

Figure 5:
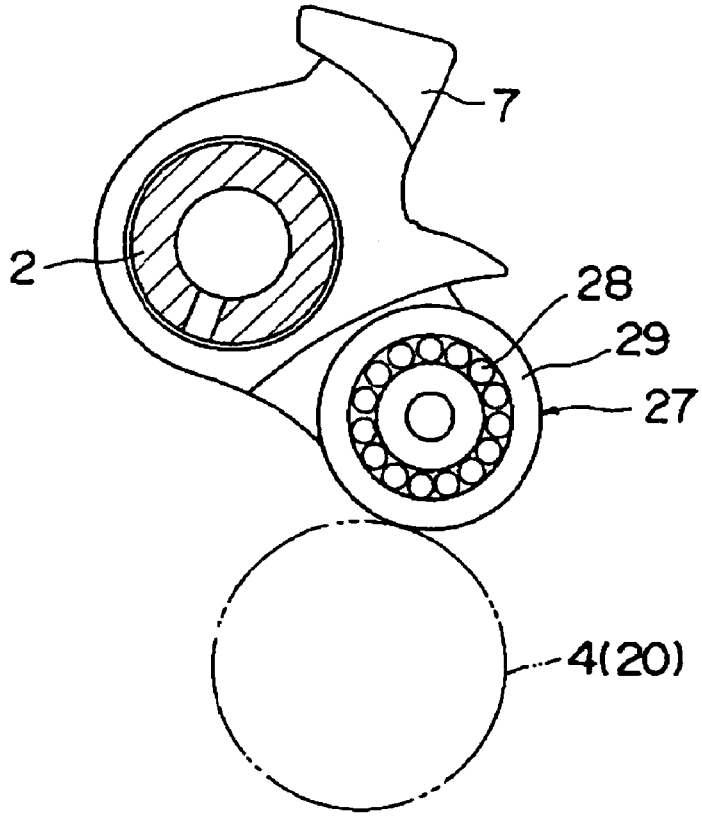
FIG. 5 is a view taken in the direction of an arrow along line V-V of FIG. 2.

As shown in FIGS. 5 and 7, a second roller follower 27 is provided in part of the base end of the second rocker arm 7, which is abutted on the high-lift cam 20. Thus, the base end of the second rocker arm 7 is abutted with no resistance on the rotating high-lift cam 20 via the second roller follower 27. The second roller follower 27 (needle bearing) is comprised of an external roller 29, which is capable of rotating via a large number of needle rollers 28, and is in rolling contact with the high-lift cam 20.

It should be noted that as is the case with the third roller follower 24, the first roller follower 21 may be comprised of the internal roller 22 and the external roller 23 (double-ring type sliding rollers), which is in rolling contact with the first low-lift cam 10.

Further, as shown in FIG. 1, exhaust rocker arms 31*a*, 31*b* are supported on the exhaust side rocker shaft 3 such that the arms 31*a*, 31*b* may rock, and each of the exhaust rocker arms 31*a*, 31*b* is adapted to be driven by an exhaust cam.

By the way, for example, it is configured such that the high-lift cam 20 lifts the first intake valve 9 and the second intake valve 11 by a large amount, the first low-lift cam 10 lifts the first intake valve 9 by a slightly smaller amount as compared with the high-lift cam 20, and the second low-lift cam 12 lifts the second intake valve 11 by a much smaller amount as compared with the high-lift cam 20.

For this reason, when pressurized oil is supplied to the cylinder parts 8 (i.e., the connected state) to rock the second rocker arm 7, thus rocking the first rocker arm 5 and the third rocker arm 6 to open and close the first intake valve 9 and the second intake valve 11 at the same time and with a large valve lift, the high-lift cam 20 lifts the first intake valve 11 and the second intake valve 11 by a larger amount as compared with the second low-lift cam 12 and the first low-lift cam 10.

Therefore, the internal combustion engine is operated in the state, in which a large gap is formed between the second low-lift cam 12 and the third roller follower 24, and a gap is formed between the first low-lift cam 10 and the first roller follower 21.

Although not described, the second rocker arm 7 is constantly urged toward the cams. In the state in which pressurized oil is supplied to the cylinder parts 8 to rock the second rocker arm 7, thus rocking the first rocker arm 5 and the third rocker arm 6 to open and close the first intake valve 9 and the second intake valve 11, when the pressurized oil is released from the cylinder parts 8, i.e., the state of intake is switched, the rocking force of the second rocker arm 7 is inhibited from being transmitted, so that the first rocker arm 5 and the second rocker arm 6 are forced to rock toward the first low-lift cam 10 and the second low-lift cam 12.

In this case, since a large gap is formed between the second low-lift cam 12 and the third roller follower 24 at the maximum valve lift, when the first rocker arm 5 and the third rocker arm 6 are forced to rock toward the first low-lift cam 10 and the second low-lift cam 12, the third roller follower 24 and the first roller follower 21 may be struck against the second low-lift cam 12 and the first low-lift cam 10.

Only a slight gap is formed between the first roller follower 21 and the first low-lift cam 10, and hence a great force never acts when the first roller follower 21 is struck against the first low-lift cam 10, whereas a large gap is formed between the third roller follower 24 and the second low-lift cam 12, and hence a great force acts when the third roller follower 24 is struck against the second low-lift cam 12.

Therefore, the third roller follower 24 has a double-ring type sliding roller structure comprised of the internal roller 22 and the external roller 23. This improves the impact strength of the third roller follower 24; if the third roller follower 24 is struck against the second low-lift cam 12 with a great force, the force is transmitted with pressure being applied to a surface, so that the third external roller 23 can be prevented from being damaged due to deformation or impression.

Thus, part of the third rocker arm 6, which is abutted on the rotating second low-lift cam 12, is constructed in consideration of stiffness and rotational resistance.

Although in the above described embodiment, in the internal combustion engine in which two different types of rocker arms i.e., the first rocker arm 5 and the third rocker arm 6 which cause smaller valve lifts as compared with the second rocker arm 7 which causes a large valve lift, the third roller follower 24 for the second low-lift cam 12 which causes a much smaller valve lift than the second rocker arm 7 has the sliding roller structure, the present invention is not limited to this, but the first roller follower 21 may be configured to have the sliding roller structure.

Further, the present invention in which a roller which abuts a cam which causes a smaller valve lift is constructed as the first roller follower having the sliding roller structure may be applied to an internal combustion engine of a one intake valve type capable of switching between two rocker arms which cause different valve lift lifts as disclosed in Japanese Laid-Open Patent Publication No. 2001-41017 filed by the applicant of the present invention.

Figure 8:
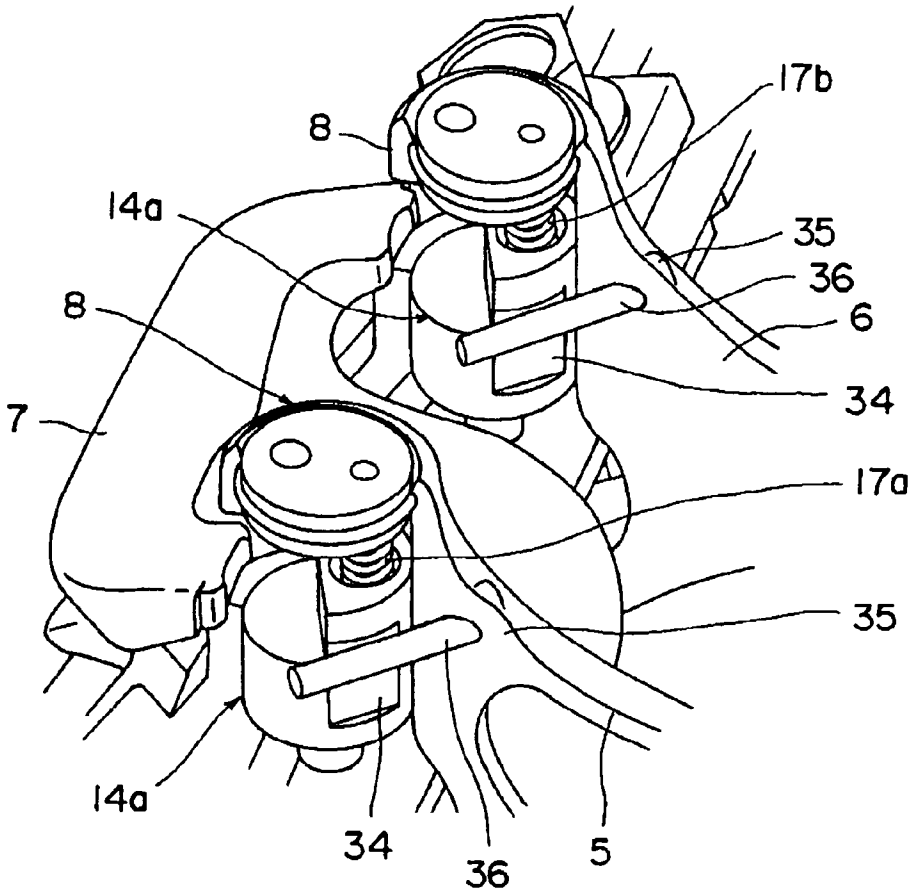
FIG. 8 is a perspective view showing a rocker arm as viewed from an intake valve.

As shown in FIG. 8, since the notches 16 are formed at the upper part of the pistons 14, the return springs 17 are arranged at locations deviated from the axes of the pistons 14. Thus, when the pistons 14 rotate about the axes thereof, the return springs 17 cannot apply force as designed. Therefore, in the illustrated embodiment, as shown in FIGS. 6 and 7, mechanisms for stopping the rotation of the pistons 14 are provided.

Figure 2:
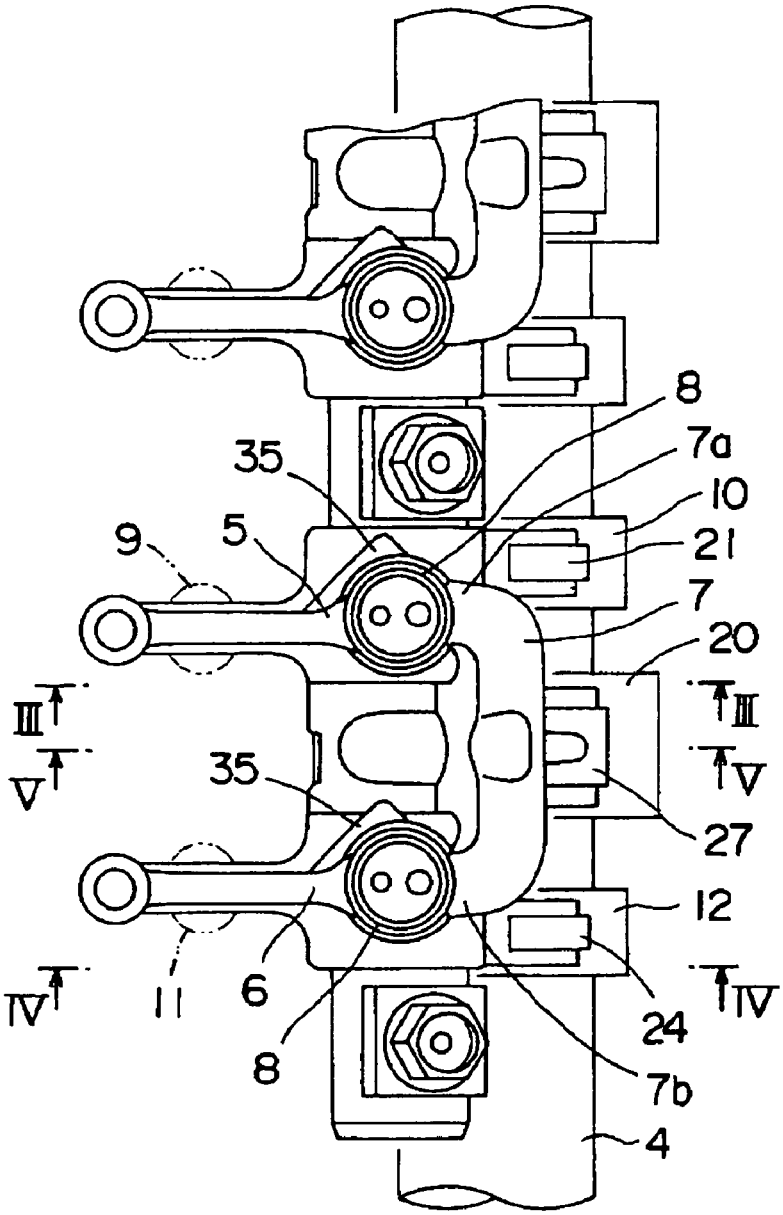
FIG. 2 is an enlarged view showing essential parts in FIG. 1.
Figure 6:
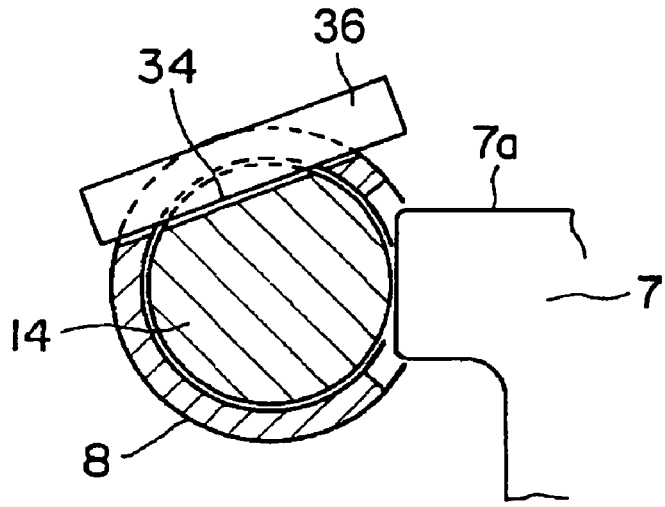
FIG. 6 is a sectional view showing a piston supporting part.

As shown in FIGS. 2, 6, and 8, notch surfaces 34 are formed on the circumference of part of the pistons 14 where the notches 16 are formed, and bosses 35 (refer to FIG. 2) corresponding to the notch surfaces 34 are formed in the cylinder parts 8 of the first rocker arm 5 and the third rocker arm 6.

The notch surfaces 34 are formed at locations away from the openings 13 in the cylinder parts 8 and away from the back surfaces of the pistons 14, and are arranged such that pins 36 are diagonally fitted on the notch surfaces 34 in an axial direction. The pins 36 are fixed in the bosses 35 by press-fitting or the like, and are arranged with its axes extending on a plane parallel with a horizontal plane along the rocker shaft 2.

To stop the rotation of the pistons 14, the pins 36 may be arranged in a direction perpendicular to the horizontal plane along the rocker shaft 2, but in this case, the cylindrical parts 15 at the lower parts of the pistons 14 must be formed with parts into which the pins 36 can be fitted. The cylindrical parts 15 are intended to prevent oil leakage by moving in sliding contact with the cylinder parts 8, but if the cylindrical parts 8 are formed with parts into which the pins 36 can be fitted, oil may leak. Therefore, the pins 36 are arranged with the axes thereof extending on the plane parallel with the horizontal plane along the rocker shaft 2.

The back surfaces of the pistons 14 have the maximum load applied thereto from the second rocker arm 7 in the case where the first rocker arm 5 and the third rocker arm 6 are caused to rock by rocking of the second rocker arm 7. For this reason, the pins 36 are diagonally arranged at locations away from the back surfaces of the pistons 14.

Further, the pins 36 are fixed on the bosses 35 and arranged at locations away from the openings 13 in the cylinder parts 8. Therefore, the ends 7*a*, 7*b* of the second rocker arm 7 are never inhibited from moving from the openings 13 toward the pitons 14, and also, the rocking force of the second rocker arm 7 can be transmitted over the entire back surfaces of the pistons 14.

The notch surfaces 15 are formed to reach middle parts of the cylindrical parts 15, and the pins 36 prevent the pistons 14 from falling off. As shown in FIGS. 2 and 8, in the cylinder parts 8 of the first rocker arms 5 and the third rocker arm 6, the bosses 35 are formed in the same direction, the notch surfaces 34 of the pistons 14 are formed in the same direction, and the pins 36 are arranged parallel with each other. Therefore, the pistons 14 of the first rocker arm 5 and the third rocker arm 6 can be shared to reduce costs required for parts and prevent erroneous assembly.

By the way, for each cylinder, the first rocker arm 5, third rocker arm 6, and second rocker arm 7 are supported on the intake side rocker shaft 2, and the first rocker arm 5 and the third rocker arm 6 are provided with respective switching mechanisms including the cylinder parts 8 and the pistons 14. For this reason, a valve switching mechanism on the intake side is more complicated and heavier than a valve switching mechanism on the exhaust side.

Therefore, according to the present invention, as shown in FIG. 1, the diameter D1 of the intake side rocker shaft 2 is set to be (e.g., about 10%) greater than the diameter D2 of the exhaust side rocker shaft 3. This secures such stiffness as to compensate for excess in weight, and improves operating characteristics of the valve system.

Further, since the diameter D1 of the rocker shaft 2 is set to be greater than the diameter D2 of the rocker shaft 3, the inner diameter of the oil channel 18 can also be increased, making it possible to reduce pressure loss in pressurized oil flowing through the oil channel 18 and to improve the performance of the switching mechanisms. Further, the rocker shaft 2 and the rocker shaft 3 cannot be shared since they have different diameters, and hence the rocker shaft 2 and the rocker shaft 3 can be designed to have respective optimum lengths.

Therefore, the stiffness and operating characteristics of the valve system can be improved while an increase in the total weight of the valve system is minimized by increasing the diameter of only the intake-side rocker shaft 2 which is required to have a high stiffness since it is provided with the complicated and heavier connection switching mechanisms as the cam switching mechanisms on the side where the second intake valve 11 is provided.

Examples of rocker arm-type valve systems include an end pivot type and a center pivot type, and particularly in the center pivot type, the stiffness of the rocker shaft 2 highly contributes to the stiffness of a valve system. Specifically, in the end pivot type in which a rocker shaft as the shaft of a rocker arm is provided at an end of the rocker arm, a counterforce of a valve spring is reduced by an urging force of a cam, and hence the stiffness of the rocker shaft is not so important, and as a result, the stiffness of the rocker shaft does not highly contribute to the stiffness of a valve system. On the other hand, in the center pivot type in which a rocker shaft is located in the middle of a rocker arm, a force obtained by adding an urging force of a cam to a counterforce of a valve spring is received by the rocker shaft, and hence the stiffness of the rocker shaft is very important. As a result, in the center pivot type, the stiffness of the rocker shaft highly contributes to the stiffness of a valve system. Particularly in an engine of the type that a single cam shaft for actuating intake valves and exhaust valves is disposed between an intake side rocker shaft and an exhaust side rocker shaft, a rocker arm needs to be long so as to obtain a desired valve included angle, and hence the stiffness of the rocker arm should necessarily be increased so as to prevent the rocker arm from curving or twisting. As a result, the weight of the rocker arm is increased. For this reason, in the valve system which has the rocker shaft 2 actuating intake valves by the center pivot process and has the switching mechanism as well as in the valve system in which the single cam shaft 4 actuates intake valves and exhaust valves, the stiffness of the entire valve system and the valve operating characteristics can be improved by increasing the diameter of the intake side rocker shaft 2.

Although in the above described embodiment, the diameter of the rocker shaft 2 on the intake side where the cam switching mechanism are provided is increased, the present invention is not limited to this, but for example, in the case of an engine in which a cam switching mechanism or the like is provided on the exhaust side and hence the weight of a valve system on the exhaust side is greater than a valve system on the intake side, the diameter of the rocker shaft 3 on the exhaust side may be increased.

Figure 9:
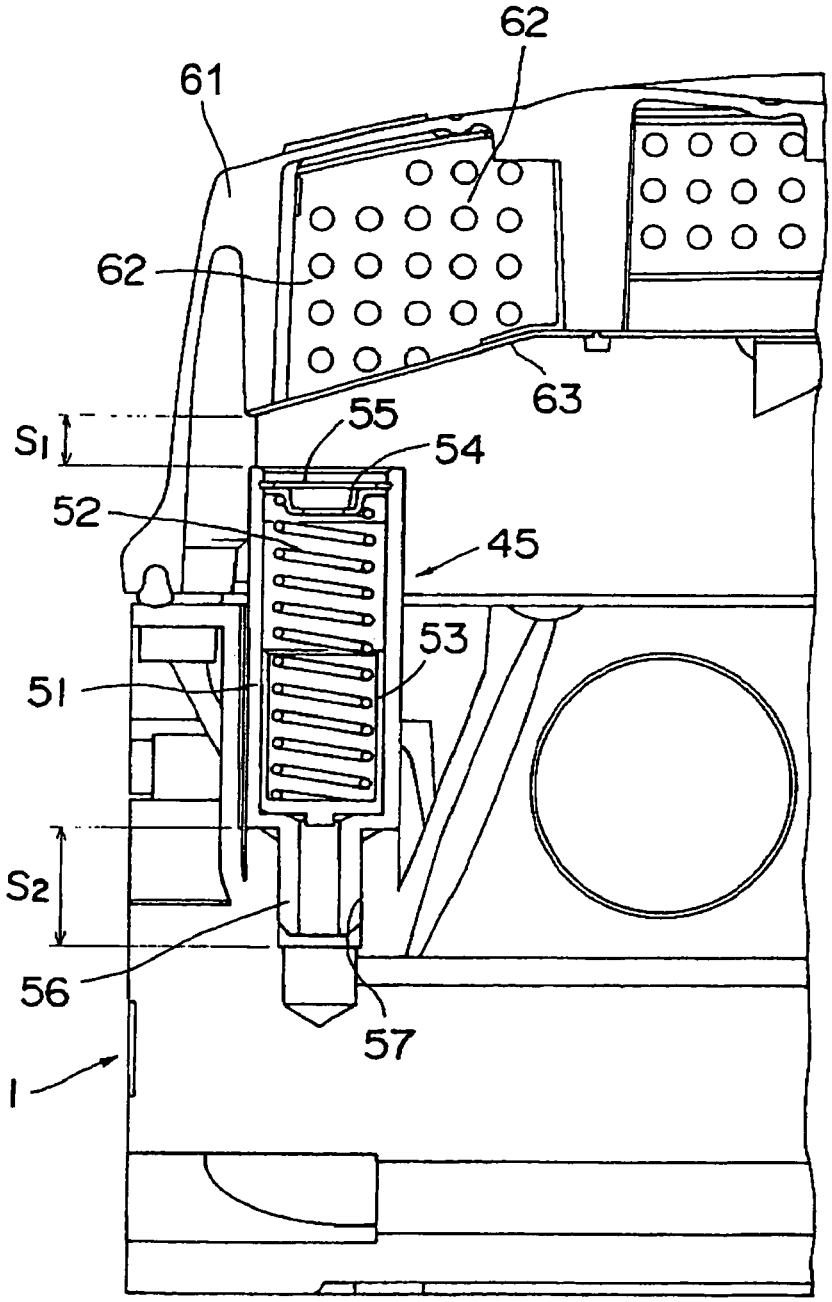
FIG. 9 is a sectional view showing the state in which an accumulator is mounted.
Figure 10:
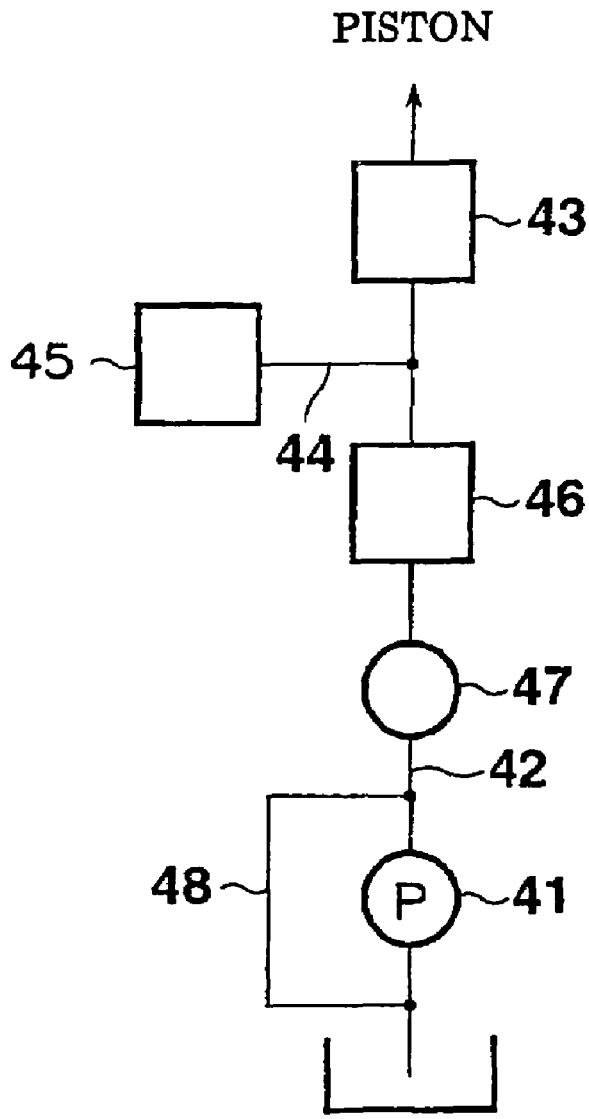
FIG. 10 is a circuit diagram schematically showing a hydraulic system.

Referring next to FIGS. 9 and 10, a description will be given of a mechanism for supplying and releasing pressurized oil to and from the oil channel 18 of the rocker shaft 2, i.e., a mechanism for driving the pistons 14 of the cylinder parts 8.

An oil channel 42, in which pressurized oil supplied from an oil pump 41 (refer to FIG. 10) flows, is formed at an end of the cylinder head 1, and an oil control valve 43 for controlling the supply/release of pressurized oil to/from the oil channel 18 is provided in the oil channel 42. An accumulating channel 44 is branched from the oil channel 42 upstream of the oil control valve 43, and an accumulator 45 is connected to the accumulating channel 44. The accumulator 45 is fixed as a member to the cylinder head 1.

A second filter 46 is provided in part of the oil channel 42 upstream of the oil control valve 43 and upstream of part from which the accumulating channel 44 is branched. In FIG. 10, reference numeral 47 denotes a first filter provided on the discharge side of the oil pump 41, and reference numeral 48 denotes a bypass for bypassing the oil pump 41 and in which a relief valve, not shown, is disposed.

As shown in FIG. 9, the accumulator 45 has a cylindrical body 51 fixed in an upright direction to the cylinder head 1, and a piston 53, which is forced downward by a spring 52, is provided in the body 51 such that the piston 53 may slide in contact with the body 51. A spring sheet 54 and a snap ring 55 are provided at the upper part of the spring 52, which is housed in the body 51.

A screw part 56 is formed at a lower part of the body 51. By screwing the screw part 56 into a female screw part 57, the accumulator 45 is fixed to the cylinder head 1. When the accumulator 45 is fixed to the cylinder head 1, part of the upper part of the body 51 is protruded from the upper surface of the cylinder head 1. Fixing the body 51 to the cylinder head 1 brings the accumulating channel 44 into communication with the body 51, so that pressurized oil is supplied to an area below a piston 53. The piston 53 moves upward against the force of the spring 52 to cause pressurized oil to be accumulated in the body 51.

The upper part of the cylinder head 1 is provided with a cover 61, in which a baffle plate 62 and a flat plate 63 are provided for catching oil mist. The flat plate 63 is located just above the upper part of the body 51 protruded from the upper surface of the cylinder head 1. For this reason, if the snap ring 55 falls out, the spring sheet 54, spring 52, and piston 53 abut the flat plate 63 to prevent pressurized oil from splashing to the outside.

A gap S1 formed between the upper part of the body 51 and the flat plate 53 is set to be shorter than a length S2 of the screw part 56. For this reason, if the body 51 fixed to the cylinder head 1 by screwing is loosened to move in a direction to fall off (upward), the upper part of the body 51 abuts on the flat plate 63 before the screw 56 is disengaged, and hence the body 51 can be prevented from falling off from the cylinder head 1. Therefore, neither the oil channel 42 nor the accumulating channel 44 is opened to the outside.

Since the body 51 of the accumulator 45 is fixed to the cylinder head 1 by means of the screw part 56 at the lower part thereof, oil never leaks from the body 51 even when e.g., oil leakage occurs at part of the body 51 which is fixed to the cylinder head 1. Therefore, it is possible to suppress oil leakage to the outside even if the part of the body 51, which is fixed to the cylinder head 1, is sealed in a simple manner. The body 51 should not necessarily be fixed to the cylinder head 1 by means of the screw part 56, but for example, the body 51 may be fixed to the cylinder head 1 by press-fitting or by using a combination of a flange and a fastening screw.

In the above described mechanism for supplying/releasing pressurized oil to/from the oil channel 19 of the rocker shaft 2, when the oil pump 41 is driven to supply pressurized oil from the oil channel 42 to the accumulating channel 44, the pressurized oil is filtered by the second filter 44 and supplied to the oil control valve 43, accumulator 45, and exhaust side rocker shaft 3. When the oil control valve 43 is off (closed), the oil pressure of the accumulating channel 44 causes pressurized oil to be accumulated in the accumulator 45.

When the engine comes to revolve at a predetermined speed, the oil control valve 43 is turned on (opened) so as to selectively actuate the high-lift cam 20. The pressurized oil rapidly flows into the oil channel 18 of the intake side rocker shaft 2 via the oil control valve 43. On this occasion, the oil pressure of the oil channel 42 and the accumulating channel 44 is temporarily decreased due to a shortage of pressurized oil supplied, and hence the pressurized oil accumulated in the accumulator 45 is pushed out by the force of the spring 52 to compensate for the shortage.

Therefore, pressurized oil can be supplied with a high responsiveness to the switching mechanism including the two cylinder parts 8 for each cylinder without causing shortage of pressurized oil.

Since the second filter 46 is disposed upstream of the accumulator 45, foreign matters included in the pressurized oil accumulated in the accumulator 45 can be removed. Therefore, it is possible to prevent foreign matters from entering the body 51 of the accumulator 45, and thus to prevent stick-slip of the piton 53.

Further, since the pressurized oil pushed out from the accumulator 45 is sent to the oil control valve 43 without passing through the second filter 46, pressurized pressure oil can be supplied with a high responsiveness to the oil channel 18 of the rocker shaft 2 without being affected by pressure loss in pressurized oil flowing through the second filter 46.

In the above described embodiment, the internal combustion engine having the switching mechanism comprised of the first rocker arm 5, third rocker arm 6, and second rocker arm 7 is used as an internal combustion engine to which the above described configuration of the accumulator 45 is applied, and as an internal combustion engine to which the above described circuit configuration in which the oil control valve filter 46 is provided, but the present invention may be applied to an internal combustion engine provided with a switching mechanism having a different configuration.

For example, the above described configuration of the accumulator 45 and/or the above described circuit configuration in which the oil control valve filter 46 is provided may be applied to an internal combustion engine of a one intake valve type which is configured to change two types of rocker arms which cause different lift valves as stated in Japanese Laid-Open Patent Publication 2001-41017 filed by the applicant of the present invention.

The invention claimed is:

1. A valve system for an internal combustion engine, comprising:

an intake-side rocker shaft;

an exhaust-side rocker shaft;

intake-side rocker arms having ends thereof connected to intake valves and supported on said intake-side rocker shaft such that said intake-side rocker arms rock, the intake-side rocker arms being driven by intake cams, the intake side rocker arms including, a first rocker arm having an end thereof connected to the intake valve and supported on said intake-side rocker shaft such that said first rocker arm rocks, the first rocker arm being driven by a first low-lift cam, and a second rocker arm having an end thereof connectable to said first rocker arm and supported on said intake-side rocker shaft, the second rocker arm being adapted to engage with the first rocker arm at an angle substantially perpendicular to a center longitudinal axis of the intake valve, such that said second rocker arm rocks, the second rocker arm being driven by a high-lift cam causing a larger valve lift than the first low-lift cam;

exhaust-side rocker arms having ends thereof connected to exhaust valves and supported on said exhaust-side rocker shaft such that said exhaust-side rocker arms rock, the exhaust-side rocker arms being driven by an exhaust cam; and a switching mechanism switching operating characteristics of the intake valves, wherein the intake-side rocker shaft is provided with the switching mechanism and has a larger diameter than the exhaust-side rocker shaft.

2. A valve system for an internal combustion engine according to claim 1, wherein said intake-side rocker arms further include, a connection switching mechanism that selectively connects or disconnects said second rocker arm to or from said first rocker arm.

3. A valve system for an internal combustion engine according to claim 1, wherein, said intake valves include a first intake valve and a second intake valve, and said intake-side rocker arms further include, a third rocker arm having an end thereof connected to said second intake valve and supported on said intake-side rocker shaft such that said third rocker arm rocks, the third rocker arm being driven by a second low-lift cam that causes a smaller valve lift than the first low-lift cam, and a connection switching mechanism that selectively connects or disconnects said second rocker arm to or from said first rocker arm and said third rocker arm.

4. A valve system for an internal combustion engine according to any of claims 1 to 3, wherein said intake-side rocker arms include center-pivot type rocker arms with middle parts thereof pivoted by said intake side rocker shaft.

5. A valve system for an internal combustion engine according to claim 4, wherein said intake-side rocker arms and said exhaust-side rocker arms are driven by a single cam shaft disposed between said intake-side rocker shaft and said exhaust-side rocker shaft.

6. A valve system for an internal combustion engine according to claim 3, wherein the first rocker arm has a first roller follower provided with a double-ring type sliding roller that makes contact with the first low-lift cam.

7. A valve system for an internal combustion engine according to claim 3, wherein the first rocker arm has a first roller follower provided with a double-ring type sliding roller that makes contact with the first low-lift cam, and the third rocker arm has second roller follower provided with a needle bearing that makes contact with the second low-lift cam.

8. A valve system for an internal combustion engine, comprising:

an intake-side rocker shaft having a first oil channel extending in a longitudinal direction thereof;

an exhaust-side rocker shaft having a second oil channel extending in a longitudinal direction thereof;

intake-side rocker arms having ends thereof connected to intake valves and supported on said intake-side rocker shaft such that said intake-side rocker arms rock, the intake-side rocker arms being driven by intake cams, the intake side rocker arms including, a first rocker arm having an end thereof connected to the intake valve and supported on said intake-side rocker shaft such that said first rocker arm rocks, the first rocker arm being driven by a first low-lift cam, and a second rocker arm having an end thereof connectable to said first rocker arm and supported on said intake-side rocker shaft, the second rocker arm being adapted to engage with the first rocker arm at an angle substantially perpendicular to a center longitudinal axis of the intake valve, such that said second rocker arm rocks, the second rocker arm being driven by a high-lift cam causing a larger valve lift than The first low-lift cam;

exhaust-side rocker arms having ends thereof connected to exhaust valves and supported on said exhaust-side rocker shaft such that said exhaust-side rocker arms rock, the exhaust-side rocker arms being driven by an exhaust cam; and a switching mechanism switching operating characteristics of the intake valves, wherein the intake-side rocker shaft is provided with the switching mechanism and has a larger diameter than the exhaust-side rocker shaft.

9. A valve system for an internal combustion engine, comprising:

an intake-side rocker shaft;

an exhaust-side rocker shaft;

intake-side rocker arms having ends thereof connected to intake valves and supported on said intake-side rocker shaft, such that said intake-side rocker arms rock, the intake-side rocker arms being driven by an intake cam;

exhaust-side rocker arms having ends thereof connected to exhaust valves and supported on said exhaust-side rocker shaft, such that said exhaust-side rocker arms rock, the exhaust-side rocker arms being driven by an exhaust cam, the exhaust-side rocker arms including, a first rocker arm having an end thereof connected to the exhaust valve and supported on said exhaust-side rocker shaft such that said first rocker arm rocks, and a second rocker arm having an end thereof connectable to said first rocker arm and supported on said exhaust-side rocker shaft, the second rocker arm being adapted to engage with the first rocker arm at an angle substantially perpendicular to a center longitudinal axis of the exhaust valve, such that said second rocker arm rocks; and a switching mechanism switching operating characteristics of the exhaust valves, wherein the exhaust-side rocker shaft is provided with the switching mechanism and has a larger diameter than the intake-side rocker shaft.

10. A valve system for an internal combustion engine according to claim 1, wherein, the first rocker arm is provided with an opening, the second rocker arm is provided with a projection that protrudes from the second rocker arm, and the projection enters the opening in the direction substantially perpendicular to the center longitudinal axis of the intake valve.

11. A valve system for an internal combustion engine according to claim 10, wherein, the opening is selectively closed by a closing unit to prevent the projection from entering the opening.

12. A valve system for an internal combustion engine according to claim 11, wherein, the closing unit is a piston having a notch portion and a cylindrical portion, and as spring accommodated inside the opening, such that the piston selectively moves between a first position that allows the projection to enter the notch portion and a second position that prevents the projection from entering the opening by the cylindrical portion.

* * * * *